US005683170A

United States Patent [19]

Blaha

[11] Patent Number: 5,683,170

[45] Date of Patent: Nov. 4, 1997

[54] ILUMINATED MASONARY BLOCK OR BRICK

[76] Inventor: Michael J. Blaha, 118 Pidgeon Hill Rd., Huntington Station, N.Y. 11746

[21] Appl. No.: 600,092

[22] Filed: Feb. 12, 1996

[51] Int. Cl.[6] ..... F21S 3/00

[52] U.S. Cl. ..... 362/145; 362/152; 362/224; 362/225; 362/355; 362/367

[58] Field of Search ..... 362/145, 146, 362/151–153, 153.1, 223–225, 362, 367, 355

[56] References Cited

U.S. PATENT DOCUMENTS

| | | | |
|---|---|---|---|
| 4,464,708 | 8/1984 | Nussli et al. | 362/224 |
| 4,532,579 | 7/1985 | Merryman | 362/367 |
| 4,812,954 | 3/1989 | Marton | 362/224 |
| 4,969,282 | 11/1990 | Eberhart | 362/145 |
| 4,992,914 | 2/1991 | Heiss et al. | 362/153.1 |
| 5,160,202 | 11/1992 | Legare | 362/153.1 |

*Primary Examiner*—Alan Cariaso
*Attorney, Agent, or Firm*—Richard L. Miller, P.E.

[57] ABSTRACT

An illuminated masonry block that includes a hollow open-topped substantially parallelepiped-shaped housing, a substantially rectangular-shaped translucent lid, and a light source. The hollow open-topped substantially parallelepiped-shaped housing has a bottom with an outer surface and an inner surface. A pair of short sides extend upwardly from the bottom and each of which have an outer surface with a lower portion, an inner surface, and a top surface with a centrally disposed aperture. A pair of long sides extend upwardly from the bottom and each of which have an outer surface and an inner surface. The bottom, the pair of short sides, and the pair of long sides of the hollow open-topped substantially parallelepiped-shaped housing define an internal chamber with an open top. The substantially rectangular-shaped translucent lid is removably mounted to the hollow open-topped substantially parallelepiped-shaped housing at the open top of the internal chamber and has an outer surface, an inner surface, and a pair of ends each of which have a throughbore. And, the light source is disposed in the internal chamber of the hollow open-topped substantially parallelepiped-shaped housing.

18 Claims, 1 Drawing Sheet

ILUMINATED MASONARY BLOCK OR BRICK

CROSS REFERENCES TO RELATED APPLICATIONS

This application contains subject matter disclosed in applicant's Disclosure Document No. 351926 filed on Apr. 12, 1994. As such, it is respectfully requested that the disclosure document be relied upon and remain a permanent part of the file history during the prosecution of the instant application and during any subsequent action thereof.

BACKGROUND OF THE INVENTION

The present invention relates to an illuminated masonry block. More particularly, the present invention relates to an illuminated masonry block that includes hollow open-topped substantially parallelepiped-shaped housing, a substantially rectangular-shaped translucent lid that closes the hollow open-topped substantially parallelepiped-shaped housing, and a light source contained in the hollow open-topped substantially parallelepiped-shaped housing.

Outdoor lighting has always been a favorite of home owners and the like. When the sun sets it is imperative to assure that for purposes of safety proper outdoor lighting is provided.

There are currently many styles of outdoor lighting. Generally speaking, there are composite concrete in the form of rocks, brass uprights in the form of spreads, uprights in the form of bollards, variable focus floods, couches for entrances, uprights in the form of wells, horizontal spans for redwood decks, variable focus spots, uprights in the form of tiers, and uprights with globes.

Numerous innovations for outdoor lights have been provided in the prior art that will be described. However, even though these innovations may be suitable for the specific individual purposes to which they address, they differ from the present invention in that they do not teach an illuminated masonry block that includes hollow open-topped substantially parallelepiped-shaped housing, a substantially rectangular-shaped translucent lid that closes the hollow open-topped substantially parallelepiped-shaped housing, and a light source contained in the hollow open-topped substantially parallelepiped-shaped housing.

FOR EXAMPLE, the Argee Corp. of 9550 Pathway St., Santee, Calif. offers a textured brick style outdoor light manufactured out of heavy duty plastic with UV inhibitors. The light brick has a green, amber, red or blue lens and can be interspersed with other plastic bridge edging.

ANOTHER EXAMPLE, the Brinkmann Corp. of 4215 McEwen Rd., Dallas, Tex. offers entrance, flood, and tier style plastic outdoor lights with a lever-action connection system. The bulb holder contains two brass points that pierce a cable to activate the light. The cable runs through a channel and the bulb holder is pivoted down until it snaps and locks. The head assembly is attached over the bulb and a ground stake.

STILL ANOTHER EXAMPLE, the Bronzelite Co. of PO Box 606, San Marco, Tex. offers entrance, flood, tier, and well style metal outdoor lights that have rounded contours, a textured dark bronze finish, and an optional matching glare shield.

YET ANOTHER EXAMPLE, the Hadco Co. of PO Box 128, Littlestown, Pa. offers entrance, flood, tier, spread, well, deck, bollard, and brick style plastic/reinforced fiberglass outdoor lights designed for rugged coastal climates or conditions with highly acidic or heavily fertilized soils.

STILL YET ANOTHER EXAMPLE, the Hanover Lantern Co. of 470 High St., Hanover, Pa. offers entrance, tier, spread, deck, and bollard style aluminum outdoor lights with an optional low voltage conversion arrangement.

YET STILL ANOTHER EXAMPLE, the Hubbell lighting Co. of 2000 Electric Way, Christianburg, Va. offers entrance, flood, tier, and spread style plastic outdoor lights that contain a photo-control timer that allows a transformer to turn on the lights at dusk.

STILL YET ANOTHER EXAMPLE, the Intermatic Corp. of Intermatic Plaza, Spring Grove, Ill. offers entrance, flood, tier, spread, well, globe, deck, and bollard style plastic outdoor lights that are convertible with interchangeable components that snap together. The floodlight has zoom-focus capability for changing the light pattern from spot to flood. A multi-angle lens distributes light evenly with interchangeable prismatic lens.

YET STILL ANOTHER EXAMPLE, the Kichler Co. of 7711 E. Pleasant Valley Rd., Cleveland, Ohio offers entrance, flood, tier, spread, well, and deck style copper outdoor lights that is painted white on the inside for reflectively. Solid brass posts have ivy leaves or cattails cast into them with a verdigris finish.

STILL YET ANOTHER EXAMPLE, the Kim Lighting Co. of PO Box 1275, Industry, Calif. offers entrance, flood, tier, spread, well, and deck style metal outdoor lights that are in a subtle variegated green color that is mid-range between the lightest and darkest foliage or in a black powder coat finish.

YET STILL ANOTHER EXAMPLE, the Liteform Designs Co. of PO Box 3316, Portland, Oreg. offers entrance, tier, spread, globe, deck, and bollard style metal and redwood outdoor lights that are treated with a water repellant preservative. Steel or aluminum fixtures are finished with gloss enamel.

STILL YET ANOTHER EXAMPLE, the Prescolite Co. of 1251 Doolittle Dr., San Leandro, Calif. offers a well style metal outdoor light with a lens in clear, bronze, or white with a LEXAN(™) vandal resistant dome.

YET STILL ANOTHER EXAMPLE, the Prestige Lighting Co. offers a brick style plastic outdoor light that is an in ground fixture for use in driveways, sidewalks, concrete decks, entranceways, and steps. The brick is opaque with a hollow open top body. A lens containing a bulb assembly is positioned on the open top of the body.

FINALLY, STILL YET ANOTHER EXAMPLE, the Toro Co. of 8111 Lyndale Ave, Blooington, Minn. offers entrance, flood, tier, spread, and deck style plastic outdoor lights that have varifocus features for changing the light beam from horizontal to vertical and for adjusting the light beam from tight spotlight to broad floodlight.

It is apparent that numerous innovations for outdoor lights have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide an illuminated masonry block or brick that avoids the disadvantages of the prior art.

ANOTHER OBJECT of the present invention is to provide an illuminated masonry block or brick that is simple and inexpensive to manufacture.

STILL ANOTHER OBJECT of the present invention is to provide an illuminated masonry block or brick that is simple to use.

BRIEFLY STATED, YET ANOTHER OBJECT of the present invention is to provide an illuminated masonry block or brick that includes a hollow open-topped substantially parallelepiped-shaped housing, a substantially rectangular-shaped translucent lid, and a light source.

STILL YET ANOTHER OBJECT of the present invention is to provide an illuminated masonry block or brick wherein the hollow open-topped substantially parallelepiped-shaped housing has a bottom with an outer surface and an inner surface.

YET ANOTHER OBJECT of the present invention is to provide an illuminated masonry block or brick wherein the hollow open-topped substantially parallelepiped-shaped housing further has a pair of short sides that extend upwardly from the bottom of the hollow open-topped substantially parallelepiped-shaped housing.

STILL YET ANOTHER OBJECT of the present invention is to provide an illuminated masonry block or brick wherein each of the pair of short sides have an outer surface with a lower portion, an inner surface, and a top surface with a centrally disposed aperture.

YET ANOTHER OBJECT of the present invention is to provide an illuminated masonry block or brick wherein the hollow open-topped substantially parallelepiped-shaped housing further has a pair of long sides that extend upwardly from the bottom of the hollow open-topped substantially parallelepiped-shaped housing.

STILL YET ANOTHER OBJECT of the present invention is to provide an illuminated masonry block or brick wherein each of the pair of long sides have an outer surface and an inner surface.

YET ANOTHER OBJECT of the present invention is to provide an illuminated masonry block or brick wherein the bottom of the hollow open-topped substantially parallelepiped-shaped housing, the pair of short sides of the hollow open-topped substantially parallelepiped-shaped housing, and the pair of long sides of the hollow open-topped substantially parallelepiped-shaped housing define an internal chamber with an open top.

STILL YET ANOTHER OBJECT of the present invention is to provide an illuminated masonry block or brick wherein the substantially rectangular-shaped translucent lid is removably mounted to the hollow open-topped substantially parallelepiped-shaped housing at the open top of the internal chamber of the hollow open-topped substantially parallelepiped-shaped housing and has an outer surface, an inner surface, and a pair of ends.

YET ANOTHER OBJECT of the present invention is to provide an illuminated masonry block or brick wherein each of the pair of ends of the substantially rectangular-shaped translucent lid has a throughbore.

STILL YET ANOTHER OBJECT of the present invention is to provide an illuminated masonry block or brick wherein the light source is disposed in the internal chamber of the hollow open-topped substantially parallelepiped-shaped housing.

YET ANOTHER OBJECT of the present invention is to provide an illuminated masonry block or brick wherein the hollow open-topped substantially parallelepiped-shaped housing is translucent.

STILL YET ANOTHER OBJECT of the present invention is to provide an illuminated masonry block or brick wherein the outer surface of the bottom of the translucent hollow open-topped substantially parallelepiped-shaped housing, the outer surface of each of the pair of short sides of the translucent hollow open-topped substantially parallelepiped-shaped housing, the outer surface of the pair of long sides of the translucent hollow open-topped substantially parallelepiped-shaped housing, and the outer surface of the substantially rectangular-shaped translucent lid are textured.

YET ANOTHER OBJECT of the present invention is to provide an illuminated masonry block or brick wherein the inner surface of the bottom of the translucent hollow open-topped substantially parallelepiped-shaped housing, the inner surface of each of the pair of short sides of the translucent hollow open-topped substantially parallelepiped-shaped housing, the inner surface of the pair of long sides of the translucent hollow open-topped substantially parallelepiped-shaped housing, and the inner surface of the substantially rectangular-shaped translucent lid are smooth.

STILL YET ANOTHER OBJECT of the present invention is to provide an illuminated masonry block or brick wherein the translucent hollow open-topped substantially parallelepiped-shaped housing is one-piece.

YET ANOTHER OBJECT of the present invention is to provide an illuminated masonry block or brick wherein the one-piece translucent hollow open-topped substantially parallelepiped-shaped housing and the substantially rectangular-shaped translucent lid are hard plastic.

STILL YET ANOTHER OBJECT of the present invention is to provide an illuminated masonry block or brick wherein the one-piece translucent hollow open-topped substantially parallelepiped-shaped housing and the substantially rectangular-shaped translucent lid are hard plastic that is tinted.

YET ANOTHER OBJECT of the present invention is to provide an illuminated masonry block or brick wherein the throughbore of each of the pair of ends of the substantially rectangular-shaped translucent lid are in alignment with a respective centrally disposed aperture of the top surface of each of the pair of short sides of the one-piece translucent hollow open-topped substantially parallelepiped-shaped housing.

STILL YET ANOTHER OBJECT of the present invention is to provide an illuminated masonry block or brick wherein the substantially rectangular-shaped lid closes the open top of the internal chamber of the one-piece translucent hollow open-topped substantially parallelepiped-shaped housing.

YET ANOTHER OBJECT of the present invention is to provide an illuminated masonry block or brick that further includes a gasket that is disposed between the substantially rectangular-shaped lid and the one-piece translucent hollow open-topped substantially parallelepiped-shaped housing.

STILL YET ANOTHER OBJECT of the present invention is to provide an illuminated masonry block or brick that further includes a self tapping screw fastener that passes through the throughbore of each of the pair of ends of the substantially rectangular-shaped translucent lid and a respective centrally disposed aperture of the top surface of each of the pair of short sides of the one-piece translucent hollow open-topped substantially parallelepiped-shaped housing.

YET ANOTHER OBJECT of the present invention is to provide an illuminated masonry block or brick the further includes a sidewardly lying substantially H-shaped translcent retaining projection that is disposed on and extends substantially the entire width of the lower portion of the outer surface of each of the pair of short sides of the one-piece translucent hollow open-topped substantially parallelepiped-shaped housing.

STILL YET ANOTHER OBJECT of the present invention is to provide an illuminated masonry block or brick wherein the sidewardly lying substantially H-shaped translucent retaining projection has an upper horizontal portion with a triangular cross section and a midpoint.

YET ANOTHER OBJECT of the present invention is to provide an illuminated masonry block or brick wherein the sidewardly lying substantially H-shaped translucent retaining projection further has a lower horizontal portion with a triangular cross section and a midpoint.

STILL YET ANOTHER OBJECT of the present invention is to provide an illuminated masonry block or brick wherein the sidewardly lying substantially H-shaped translucent retaining projection further has a vertical portion with a triangular cross section that extends from the midpoint of the horizontal portion of the sidewardly lying substantially H-shaped translucent retaining projection to the midpoint of the lower horizontal portion of the sidewardly lying substantially H-shaped translucent retaining projection.

YET ANOTHER OBJECT of the present invention is to provide an illuminated masonry block or brick wherein the light source includes a light socket disposed on the inner surface of a one of the pair of short sides of the one-piece translucent hollow open-topped substantially parallelepiped-shaped housing.

STILL YET ANOTHER OBJECT of the present invention is to provide an illuminated masonry block or brick wherein the light source further includes a bulb removably mounted to the light socket and extends inwardly into the internal chamber of the one-piece translucent hollow open-topped substantially parallelepiped-shaped housing.

YET ANOTHER OBJECT of the present invention is to provide an illuminated masonry block or brick wherein the bulb is selected from the group consisting of fluorescent and incandescent.

STILL YET ANOTHER OBJECT of the present invention is to provide an illuminated masonry block or brick wherein the bulb is powered by a power source selected from the group consisting of 120V and 12V with a transformer.

FINALLY, STILL YET ANOTHER OBJECT of the present invention is to provide an illuminated masonry block or brick wherein the power source further includes a power cable that enters through a power cable housing throughbore disposed on the one-piece translucent hollow open-topped substantially parallelepiped-shaped housing that extends from the power source to the light socket.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

Figure 4:
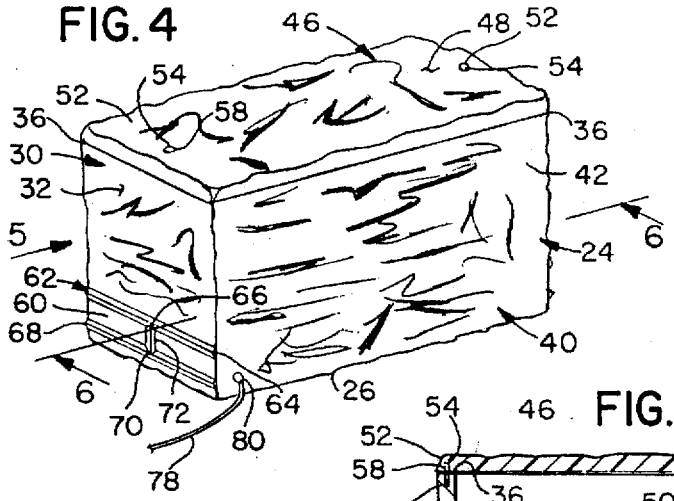
FIG. 4 is a diagrammatic perspective view of the present invention.

List of Reference Numerals of Reference Numerals Utilized in the Drawing

10 illuminated masonry block or brick of the present invention
12 conventional blocks
14 driveway wall
16 driveway curb
18 driveway 18
20 brick wall
21 ground
22 stairway
24 one-piece hollow open-topped substantially parallelepiped-shaped translucent housing
26 housing substantially rectangular-shaped translucent bottom
28 housing substantially rectangular-shaped translucent bottom textured outer surface
29 housing substantially rectangular-shaped translucent bottom smooth inner surface
30 pair of housing substantially rectangular-shaped translucent short sides
32 housing substantially rectangular-shaped translucent short side textured outer surface
34 housing substantially rectangular-shaped translucent short side smooth inner surface
∓housing substantially rectangular-shaped translucent short side smooth top surface
38 housing short side smooth top surface centrally disposed aperture
40 pair of housing substantially rectangular-shaped translucent long sides
42 housing substantially rectangular-shaped translucent long side textured outer surface
44 housing substantially rectangular-shaped translucent long side smooth inner surface
45 housing internal chamber
46 substantially rectangular-shaped translucent lid
47 housing internal chamber open top
48 substantially rectangular-shaped translucent lid textured outer surface
50 substantially rectangular-shaped translucent lid smooth inner surface
52 pair of substantially rectangular-shaped translucent lid ends
54 lid end throughbore
56 gasket
58 screw fastener
60 housing substantially rectangular-shaped translucent short side textured outer surface lower portion
62 sidewardly lying substantially H-shaped translucent retaining projection
64 sidewardly lying substantially H-shaped translucent retaining projection triangular cross sectioned upper horizontal portion

66 sidewardly lying substantially H-shaped translucent retaining projection upper horizontal portion midpoint
68 sidewardly lying substantially H-shaped translucent retaining projection triangular cross sectioned lower horizontal portion
70 sidewardly lying substantially H-shaped translucent retaining projection lower horizontal portion midpoint
72 sidewardly lying substantially H-shaped translucent retaining projection triangular cross sectioned vertical portion
74 light socket
76 light source
78 power cable
80 power cable housing throughbore

DETAILED DESCRIPTION OF THE PREFERRED EMBODIMENT

Figure 1:
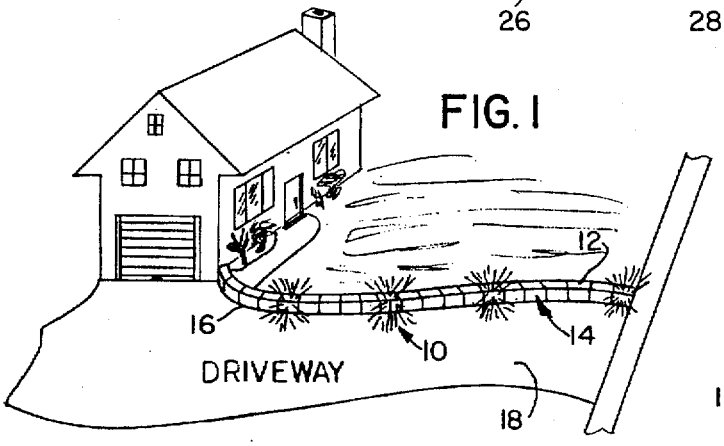
FIG. 1 is a diagrammatic perspective view illustrating the present invention installed on the curb of a driveway for illuminating same.
Figure 2:
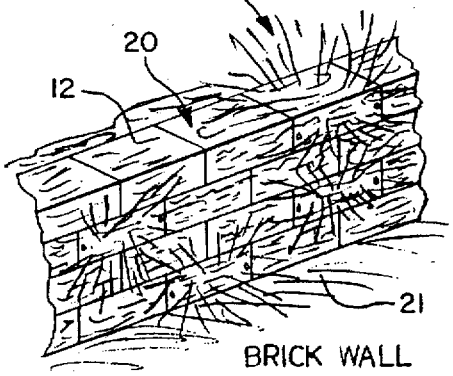
FIG. 2 is a diagrammatic perspective view illustrating the present invention installed as part of a wall for illuminating same.
Figure 3:
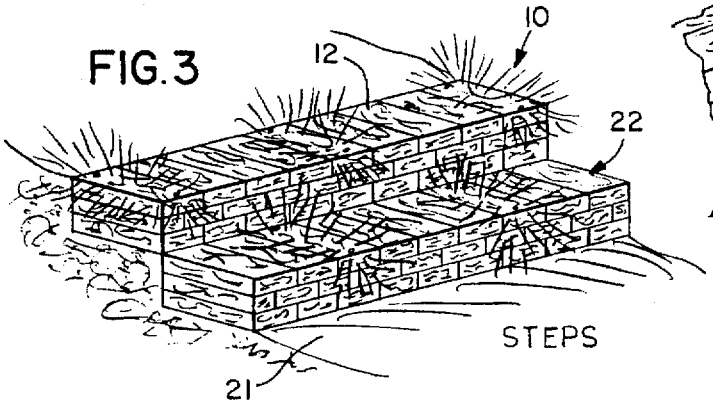
FIG. 3 is a diagrammatic perspective view illustrating the present invention installed as part of a stairway for illuminating same.

Referring now to the figures in which like numerals indicate like parts, and particularly to FIGS. 1–3, respectively, the illuminated masonry block or brick of the present invention is shown generally at 10, intermingled with conventional blocks 12 to form a driveway wall 14 that is disposed on a driveway curb 16 of a driveway 18 for illuminating the driveway 18, intermingled with the conventional blocks 12 to form a brick wall 20 disposed on a ground 21 for illuminating the brick wall 20, and intermingled with the conventional blocks 12 to form a stairway 22 disposed an the ground 21 for illuminating the stairway 22.

The illuminated masonry block or brick 10 may be the same color and texture as the conventional blocks 12, but is not limited to that, and is left to the choice of the user.

Figure 5:
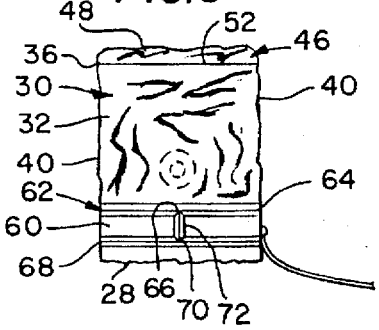
FIG. 5 is an end elevational view taken in the direction of arrow 5 in FIG. 4.
Figure 6:
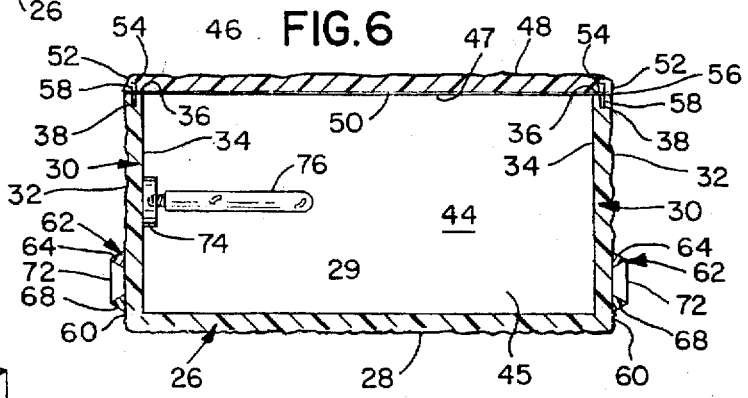
FIG. 6 is a cross sectional view taken on line 6—6 in FIG. 4.

The configuration of the illuminated masonry block or brick 10 can best be seen in FIGS. 4–6, and as such, will be discussed with reference thereto.

The illuminated masonry block or brick 10 includes a one-piece hollow open-topped substantially parallelepiped-shaped translucent housing 24.

The one-piece hollow open-topped substantially parallelepiped-shaped translucent housing 24 has a housing substantially rectangular-shaped translucent bottom 26 with a housing substantially rectangular-shaped translucent bottom textured outer surface 28 and a housing substantially rectangular-shaped translucent bottom smooth inner surface 29.

The one-piece hollow open-topped substantially parallelepiped-shaped translucent housing 24 further has a pair of housing substantially rectangular-shaped translucent short sides 30 each of which extending upwardly from, and integrally molded with, the housing substantially rectangular-shaped translucent bottom 26 of the one-piece hollow open-topped substantially parallelepiped-shaped translucent piece housing 24 and having a housing substantially rectangular-shaped translucent short side textured outer surface 32, a housing substantially rectangular-shaped translucent short side smooth inner surface 34, and a housing substantially rectangular-shaped translucent short side smooth top surface 36 with a housing short side smooth top surface centrally disposed aperture 38.

The one-piece hollow open-topped substantially parallelepiped-shaped translucent housing 24 further has a pair of housing substantially rectangular-shaped translucent long sides 40 each of which extending upwardly from, and integrally molded with, the housing substantially rectangular-shaped translucent bottom 26 of the one-piece hollow open-topped substantially parallelepiped-shaped translucent housing 24 and having a housing substantially rectangular-shaped translucent long side textured outer surface 42, and a housing substantially rectangular-shaped translucent long side smooth inner surface 44.

The housing substantially rectangular-shaped translucent bottom 26 of the one-piece hollow open-topped substantially parallelepiped-shaped translucent housing 24, the pair of housing substantially rectangular-shaped translucent short sides 30 of the one-piece hollow open-topped substantially parallelepiped-shaped translucent housing 24, and the pair of housing substantially rectangular-shaped translucent long sides 40 of the one-piece hollow open-topped substantially parallelepiped-shaped translucent housing 24 define a housing internal chamber 45 with a housing internal chamber open top 47.

A substantially rectangular-shaped translucent lid 46 is removably mounted to the one-piece hollow open-topped substantially parallelepiped-shaped translucent housing 24 at the housing internal chamber open top 47 of the housing internal chamber 45. The substantially rectangular-shaped translucent lid 46 has a substantially rectangular-shaped translucent lid textured outer surface 48, a substantially rectangular-shaped translucent lid smooth inner surface 50, and a pair of substantially rectangular-shaped translucent lid ends 52 each of which having a lid end throughbore 54.

The one-piece hollow open-topped substantially parallelepiped-shaped translucent housing 24 and the substantially rectangular-shaped translucent lid 46 are manufactured from LEXON(™) which is a hard translucent plastic that may be tinted if so desired. LEXON(™) is a registered trademark of G.E.

When the substantially rectangular-shaped translucent lid 46 is mounted onto the one-piece hollow open-topped substantially parallelepiped-shaped translucent housing 24, the substantially rectangular-shaped transparent lid 46 closes the housing internal chamber open top 47 of the housing internal chamber 45 and the lid end throughbore 54 of each of the pair of substantially rectangular-shaped translucent lid ends 52 of the substantially rectangular-shaped lid 46 is in alignment with a respective housing short side smooth top surface centrally disposed aperture 38 of the housing substantially rectangular-shaped translucent short side smooth top surface 36 of the pair of housing substantially rectangular-shaped translucent short sides 30 of the one-piece hollow open-topped substantially parallelepiped-shaped translucent housing 24.

A gasket 56 is disposed between the substantially rectangular-shaped translucent lid 46 and the one-piece hollow open-topped substantially parallelepiped-shaped translucent housing 24 and a screw fastener 58 passes through the lid end throughbore 54 of each of the pair of substantially rectangular-shaped translucent lid ends 52 of the substantially rectangular-shaped translucent lid 46 and the aligned respective housing short side smooth top surface centrally disposed aperture 38 of the housing substantially rectangular-shaped translucent short side smooth top surface 36 of the pair of housing substantially rectangular-shaped translucent short sides 30 of the one-piece hollow open-topped substantially parallelepiped-shaped translucent housing 24.

Disposed on a housing substantially rectangular-shaped translucent short side textured outer surface lower portion 60 of the housing substantially rectangular-shaped translucent short side textured outer surface 32 of each of the pair of housing substantially rectangular-shaped translucent short sides 30 of the one-piece hollow open-topped substantially parallelepiped-shaped translucent housing 24 and integrally molded therewith is a sidewardly lying substantially H-shaped translucent retaining projection 62 that extends substantially the entire width of the housing substantially rectangular-shaped translucent short side textured outer surface lower portion 60 of the housing substantially rectangular-shaped translucent short side textured outer surface 32 of each of the pair of housing substantially rectangular-shaped translucent short sides 30 of the one-piece hollow open-topped substantially parallelepiped-shaped translucent housing 24.

The sidewardly lying substantially H-shaped translucent retaining projection 62 has a sidewardly lying substantially H-shaped translucent retaining projection triangular cross sectioned upper horizontal portion 64 with a sidewardly lying substantially H-shaped translucent retaining projection upper horizontal portion midpoint 66.

The sidewardly lying substantially H-shaped translucent retaining projection 62 further has a sidewardly lying substantially H-shaped translucent retaining projection triangular cross sectioned lower horizontal portion 68 with a sidewardly lying substantially H-shaped translucent retaining projection lower horizontal portion midpoint 70.

The sidewardly lying substantially H-shaped translucent retaining projection 62 further has a sidewardly lying substantially H-shaped translucent retaining projection triangular cross sectioned vertical portion 72 that extends from the sidewardly lying substantially H-shaped translucent retaining projection upper horizontal portion midpoint 66 of the sidewardly lying substantially H-shaped translucent retaining projection triangular cross sectioned upper horizontal portion 64 of the sidewardly lying substantially H-shaped translucent retaining projection 62 to the sidewardly lying substantially H-shaped translucent retaining projection lower horizontal portion midpoint 70 of the sidewardly lying substantially H-shaped translucent retaining projection triangular cross sectioned lower horizontal portion 68 of the sidewardly lying substantially H-shaped translucent retaining projection 62.

The provision of the sidewardly lying substantially H-shaped translucent retaining projection 62 provides for greater retention for the illuminated masonry block or brick 10 when the illuminated masonry block or brick 10 is placed in concrete, in the ground or when mortar is applied thereto. Additionally, the symmetrical configuration of the sidewardly lying substantially H-shaped translucent retaining projection 62 and triangular cross section of the portions of the sidewardly lying substantially H-shaped translucent retaining projection 62, provides for easier sideways release of the one-piece hollow open-topped substantially parallelepiped-shaped translucent housing 24 from a tri-part mold when the one-piece hollow open-topped substantially parallelepiped-shaped translucent housing 24 is molded.

A light socket 74 is disposed on the housing substantially rectangular-shaped translucent short side smooth inner surface 34 of the one of the pair of housing substantially rectangular-shaped translucent short sides 30 of the one-piece housing hollow open-topped substantially parallelepiped-shaped translucent housing 24.

A light source 76 is removably mounted to the light socket 74 and extends inwardly into, and when energized illuminates, the housing internal chamber 45. The light source 76 may be a fluorescent or incandescent bulb and is illuminated by either a 120V or a 12V power source (not shown). In the case of the 12V power source (not shown), a transformer (not shown) is used.

Power from the power source (not shown) is supplied to the light source 76 by way of a power cable 78 that enters through a power cable housing throughbore 80 disposed on the one-piece hollow open-topped substantially parallelepiped-shaped translucent housing 24.

The gasket 56 and the screw fasteners 58 provide an environmental seal in a secure fashion to protect the light socket 74, the light source 76, and the power cable 78.

The method of using the illuminated masonry block or brick 10 as a component in a driveway wall 14 can best be seen in FIG. 1, and as such, will be discussed with reference thereto.

At least one illuminated masonry block or brick 10, intermingled with the conventional bricks 12, is positioned on the driveway curb 16 of the driveway 18 with the sidewardly lying substantially H-shaped translucent retaining projections 62 (not shown) orientated substantially horizontally below ground level.

Mortar may be applied intermediate adjacent the at least one illuminated masonry block or brick 10 and the conventional bricks 12 to facilitate holding therebetween.

With this positioning, the sidewardly lying substantially H-shaped translucent retaining projection 62 (not shown) is secured within the ground and the substantially rectangular-shaped translucent lid 46 faces upward so that when necessary, the light source 76 (not shown) can be easily accessed and changed. When power is applied from the power source (not shown), the at least one illuminated masonry block or brick 10 illuminates and the driveway 10 becomes illuminated.

The method of using the illuminated masonry block or brick 10 as a component in a brick wall 14 can best be seen in FIG. 2, and as such, will be discussed with reference thereto.

A first row of at least one illuminated masonry block or brick 10, intermingled with the conventional bricks 12, is positioned on the ground 21 with the sidewardly lying substantially H-shaped translucent retaining projections 62 (not shown) oriented substantially vertically and facing each other.

Subsequent rows of the at least one illuminated masonry block or brick 10, intermingled with the conventional bricks 12, are positioned atop a previous row of the at least one illuminated masonry block or brick 10, intermingled with the conventional bricks 12, until the desired height is reached.

Mortar may be applied intermediate adjacent at least one illuminated masonry block or brick 10, the conventional bricks 12, and the rows formed therefrom to facilitate holding therebetween.

With this positioning, the substantially rectangular-shaped translucent lid 46 faces outwardly or rearwardly so that when necessary, the light source 76 (not shown) can be easily accessed and changed. When power is applied to the power source (not shown), the at least one illuminated masonry block or brick 10 illuminates and the brick wall 20 becomes illuminated.

The method of using the illuminated masonry block or brick 10 as a component in a stairway 22 can best be seen in FIG. 3, and as such, will be discussed with reference thereto.

A first row of at least one illuminated masonry block or brick 10, intermingled with the conventional bricks 12, is positioned on the ground 21 with the sidewardly lying substantially H-shaped translucent retaining projections 62

(not shown) oriented substantially horizontally and facing forwardly and rearwardly.

Subsequent rows of the at least one illuminated masonry block or brick 10 and the conventional bricks 12 are positioned atop of, and setback from, previous rows of the at least illuminated masonry block or brick 10 and conventional bricks 12 until the desired height is reached.

Mortar may be applied intermediate adjacent at least one illuminated masonry block or brick 10, the conventional bricks 12, and the rows formed therefrom to facilitate holding therebetween.

With this positioning, the substantially rectangular-shaped translucent lid 46 faces upwardly so that when necessary, the light source 76 (not shown) can be easily accessed and changed. When power is applied to the power source (not shown), the at least one illuminated masonry block or brick 10 illuminates and the stairway 22 becomes illuminated.

It will be understood that each of the elements described above, or two or more together, may also find a useful application in other types of constructions differing from the types described above.

While the invention has been illustrated and described as embodied in a illuminated masonry block or brick, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An illuminated masonry block, comprising:

a) a hollow open-topped substantially parallelepiped-shaped housing having a bottom with an outer surface and an inner surface, a pair of short sides extending upwardly from said bottom of said hollow open-topped substantially parallelepiped-shaped housing and each of which having an outer surface with a lower portion, an inner surface, and a top surface with a centrally disposed aperture, a pair of long sides extending upwardly from said bottom of said hollow open-topped substantially parallelepiped-shaped housing and each of which having an outer surface and an inner surface, said bottom of said hollow open-topped substantially parallelepiped-shaped housing, said pair of short sides of said hollow open-topped substantially parallelepiped-shaped housing, and said pair of long sides of said hollow open-topped substantially parallelepiped-shaped housing defining an internal chamber with an open top; said hollow open-topped substantially parallelepiped-shaped housing being translucent; said outer surface of said bottom of said translucent hollow open-topped substantially paralleleipiped-shaped housing, said outer surface of each of said pair of short sides of said translucent hollow open-topped substantially paralleleipiped-shaped housing, said outer surface of said pair of long sides of said translucent hollow open-topped substantially parallelepiped-shaped housing, and said outer surface of said substantially rectangular-shaped translucent lid being textured;

b) a substantially rectangular-shaped translucent lid being removably mounted to said hollow open-topped substantially parallelepiped-shaped housing at said open top of said internal chamber of said hollow open-topped substantially parallelepiped-shaped housing and having an outer surface, an inner surface, and a pair of ends each of which having a throughbore; and c) a light source disposed in said internal chamber of said hollow open-topped substantially parallelepiped-shaped housing.

2. The block as defined in claim 1, wherein said inner surface of said bottom of said translucent hollow open-topped substantially parallelepiped-shaped housing, said inner surface of each of said pair of short sides of said translucent hollow open-topped substantially parallelepiped-shaped housing, said inner surface of said pair of long sides of said translucent hollow open-topped substantially parallelepiped-shaped housing, and said inner surface of said substantially rectangular-shaped translucent lid are smooth.

3. The block as defined in claim 2, wherein said translucent hollow open-topped substantially parallelepiped-shaped housing is one-piece.

4. The block as defined in claim 3, wherein said one-piece translucent hollow open-topped substantially parallelepiped-shaped housing and said substantially rectangular-shaped translucent lid are hard plastic.

5. The block as defined in claim 4, wherein said one-piece translucent hollow open-topped substantially parallelepiped-shaped housing and said substantially rectangular-shaped translucent lid are hard plastic that is tinted.

6. The block as defined in claim 5, wherein said throughbore of each of said pair of ends of said substantially rectangular-shaped translucent lid are in alignment with a respective said centrally disposed aperture of said top surface of each of said pair of short sides of said one-piece translucent hollow open-topped substantially parallelepiped-shaped housing.

7. The block as defined in claim 6, wherein said substantially rectangular-shaped lid closes said open top of said internal chamber of said one-piece translucent hollow open-topped substantially parallelepiped-shaped housing.

8. The block as defined in claim 7; further comprising a gasket that is disposed between said substantially rectangular-shaped lid and said one-piece translucent hollow open-topped substantially parallelepiped-shaped housing.

9. The block as defined in claim 8, further comprising a screw fastener that passes through said throughbore of each of said pair of ends of said substantially rectangular-shaped translucent lid and a respective said centrally disposed aperture of said top surface of each of said pair of short sides of said one-piece translucent hollow open-topped substantially parallelepiped-shaped housing.

10. The block as defined in claim 9; further comprising a sidewardly lying substantially H-shaped translucent retaining projection that is disposed on and extends substantially the entire width of said lower portion of said outer surface of each of said pair of short sides of said one-piece translucent hollow open-topped substantially parallelepiped-shaped housing.

11. The block as defined in claim 10, wherein said sidewardly lying substantially H-shaped translucent retaining projection has an upper horizontal portion with a triangular cross section and a midpoint.

12. The block as defined in claim 11, wherein said sidewardly lying substantially H-shaped translucent retaining projection further has a lower horizontal portion with a triangular cross section and a midpoint.

13. The block as defined in claim 12, wherein said sidewardly lying substantially H-shaped translucent retaining projection further has a vertical portion with a triangular cross section that extends from said midpoint of said horizontal portion of said sidewardly lying substantially H-shaped translucent retaining projection to said midpoint of said lower horizontal portion of said sidewardly lying substantially H-shaped translucent retaining projection.

14. The block as defined in claim 13, wherein said light source includes a light socket disposed on said inner surface of a one of said pair of short sides of said one-piece translucent hollow open-topped substantially parallelepiped-shaped housing.

15. The block as defined in claim 14, wherein said light source further includes a bulb removably mounted to said light socket and extends inwardly into said internal chamber of said one-piece translucent hollow open-topped substantially parallelepiped-shaped housing.

16. The block as defined in claim 15, wherein said bulb is selected from the group consisting of fluorescent and incandescent.

17. The block as defined in claim 16, wherein said bulb is powered by a power source selected from the group consisting of 120V and 12V with a transformer.

18. The block as defined in claim 17, wherein said power source further includes a power cable that enters through a power cable housing throughbore disposed on said one-piece translucent hollow open-topped substantially parallelepiped-shaped housing that extends from said power source to said light socket.

* * * * *